United States Patent [19]

Payne

[11] 4,357,589

[45] Nov. 2, 1982

[54] TEMPERATURE RESPONSIVE ELECTRICAL SWITCH CONSTRUCTION, PARTS THEREFOR AND METHODS OF MAKING THE SAME

[75] Inventor: Frank Payne, Knoxville, Tenn.

[73] Assignee: Robertshaw Controls Company, Richmond, Va.

[21] Appl. No.: 187,498

[22] Filed: Sep. 15, 1980

[51] Int. Cl.[3] ..... H01H 37/44

[52] U.S. Cl. ..... 337/315; 200/67 B; 337/409

[58] Field of Search ..... 337/315, 310, 306, 318, 337/317, 409; 236/86, 100; 73/368.3; 200/67 B, 159 A, 153 LA

[56] References Cited

U.S. PATENT DOCUMENTS 3,327,946 6/1967 Benson ..... 200/67 B 3,573,409 4/1971 Jeffrey et al. ..... 200/81.4

3,771,088 11/1973 Sliger ..... 337/315

*Primary Examiner*—Harold Broome

*Attorney, Agent, or Firm*—Candor, Candor & Tassone

[57] ABSTRACT

A temperature responsive electrical switch construction having electrical contacts operated by a stem of a piston and cylinder type thermal device carried by the construction, the contacts comprising a plurality of pairs of cooperating contacts arranged to have each cooperating pair thereof operated serially by the stem as the thermal device senses different predetermined temperatures. Each pair of cooperating contacts comprises a fixed contact and a movable contact. The construction has a plurality of terminals projecting therefrom and being substantially parallel to each other and to the stem, the fixed contacts being respectively carried by the terminals.

56 Claims, 8 Drawing Figures

TEMPERATURE RESPONSIVE ELECTRICAL SWITCH CONSTRUCTION, PARTS THEREFOR AND METHODS OF MAKING THE SAME

BACKGROUND OF THE INVENTION

1. Field of the Invention

This invention relates to an improved temperature responsive electrical switch construction and method of making the same as well as to improved parts of such an electrical switch construction and method of making the same.

2. Prior Art Statement

It is known to provide a temperature responsive electrical switch construction having electrical contact means operated by the stem means of a piston and cylinder type thermal device carried by the construction.

For example, see the following United States Patent:

(1) U.S. Pat. To Payne, No. 3,960,124

It appears that the stem means of the piston and cylinder type thermal device operates only one electrical switch means when a predetermined temperature is sensed by the thermal devices.

It is also known to provide an electrical switch construction having electrical contact means operated by an axially movable plunger means carried by the construction, the contact means comprising a plurality of pairs of cooperating contacts arranged to have each cooperating pair thereof operated serially by the plunger means as the plunger means axially moves between the cooperating pairs of contact means. Each pair of such cooperating contacts comprises a fixed contact and a movable contact with each movable contact being snap acting and with each movable contact having a pivot member pivotally mounted to the construction.

For example, see the following United States Patent:

(2) U.S. Pat. to Jeffrey et al, No. 3,573,409.

SUMMARY OF THE INVENTION

It is a feature of this invention to provide an improved temperature responsive electrical switch construction that utilizes a thermal device of the piston and cylinder type.

In particular, it was found according to the teachings of this invention that the stem means that is operated by the piston and cylinder type thermal device could be utilized to serially operate a plurality of electrical switches at different temperatures sensed by the thermal device.

Accordingly, one embodiment of this invention provides a temperature responsive electrical switch construction having electrical contact means operated by a stem means of a piston and cylinder type thermal device carried by the construction, the contact means comprising a plurality of pairs of cooperating contacts arranged to have each cooperating pair thereof operated serially by the stem means as the thermal device senses different predetermined temperatures.

Each pair of cooperating contacts comprises a fixed contact and a movable contact. The construction has a plurality of terminals projecting therefrom and being substantially parallel to each other and to the stem means, the fixed contacts being respectively carried by the terminals.

It is another feature of this invention to provide improved parts for such an electrical switch construction or the like.

For example, this invention provides an unique arrangement of contact means to be operated by an axially movable plunger or stem means that is disposed to move between the cooperating pairs of contact means.

Accordingly, it is an object of this invention to provide an improved temperature responsive electrical switch construction having one or more of the novel features of this invention as set forth above or hereinafter shown or described.

Another object of this invention is to provide a method of making such a temperature responsive electrical switch construction, the method of this invention having one or more of the novel features of this invention as set forth above or hereinafter shown or described.

Another object of this invention is to provide improved parts for such an electrical switch construction or the like, the improved parts of this invention having one or more of the novel features of this invention as set forth above or hereinafter shown or described.

Another object of this invention is to provide a method of making such improved parts, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
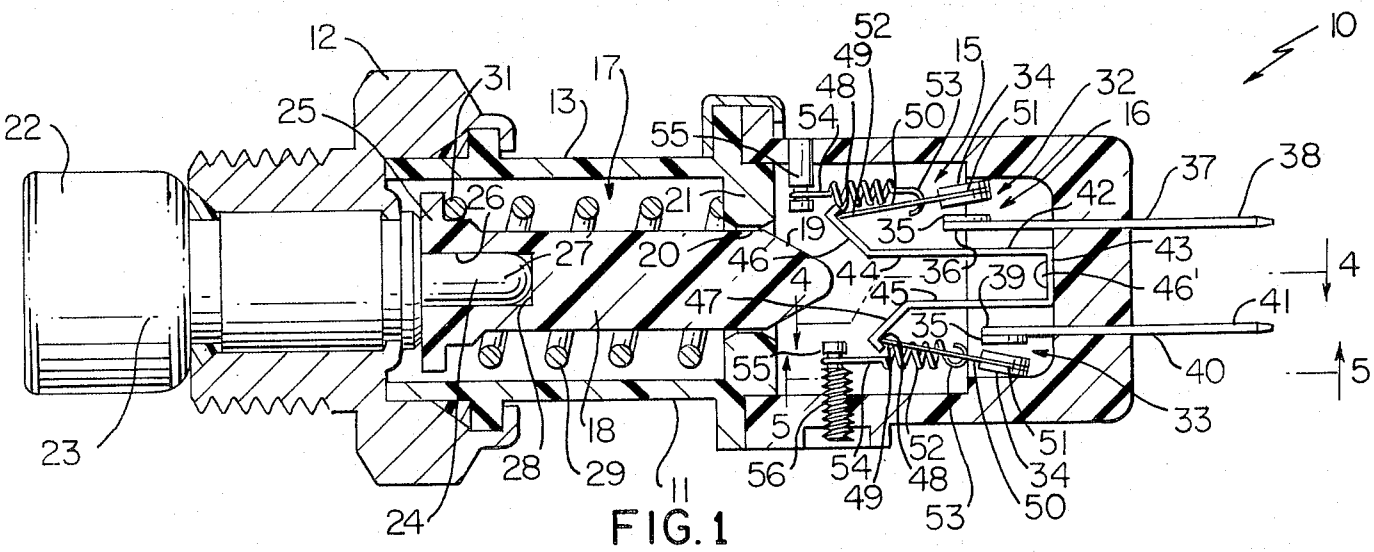
FIG. 1 is a cross-sectional view of the improved temperature responsive electrical switch construction of this invention.

While the various features of this invention are hereinafter described and illustrated as being particularly adapted to provide an electrical switch construction that is operated by a temperature responsive device of the piston and cylinder type, it is to be understood that the various features of this invention can be utilized singly or in any combination thereof to provide an electrical switch construction that is operated by other types of actuators as desired.

Therefore, this invention is not to be limited to only the embodiment illustrated in the drawings, because the drawings are merely utilized to illustrate one of the wide varieties of uses of this invention.

Referring now to FIG. 1, the improved temperature responsive electrical switch construction of this invention is generally indicated by the reference numeral 10 and comprises a housing means 11 formed from a plurality of housing parts 12, 13 and 14 suitably secured together to define a first chamber 15 therein that contains electrical switch means of this invention that are generally indicated by the reference numeral 16.

The housing means 11 defines another chamber 17 therein that contains an axially movable stem means or plunger means 18, the stem means 18 having a free end 19 projecting through a guide opening 20 in a wall 21 that separates the chamber 17 from the chamber 15 whereby the stem means 18 is adapted to operate the electrical switch means 16 in a manner hereinafter described.

The housing member 12 carries a thermal device 22 of the piston and cylinder type that is well known in the art and comprises a cylinder means 23 and a piston means 24 that is adapted to project axially out of the cylinder means 23 and be axially extended as a wax charge or the like in the cylinder 23 expands upon sensing predetermined temperatures in a manner well known in the art. For example, see the aforementioned U.S. Pat. to Payne, No. 3,960,124 for a showing and a discussion of such a typical thermal device.

Figure 2:
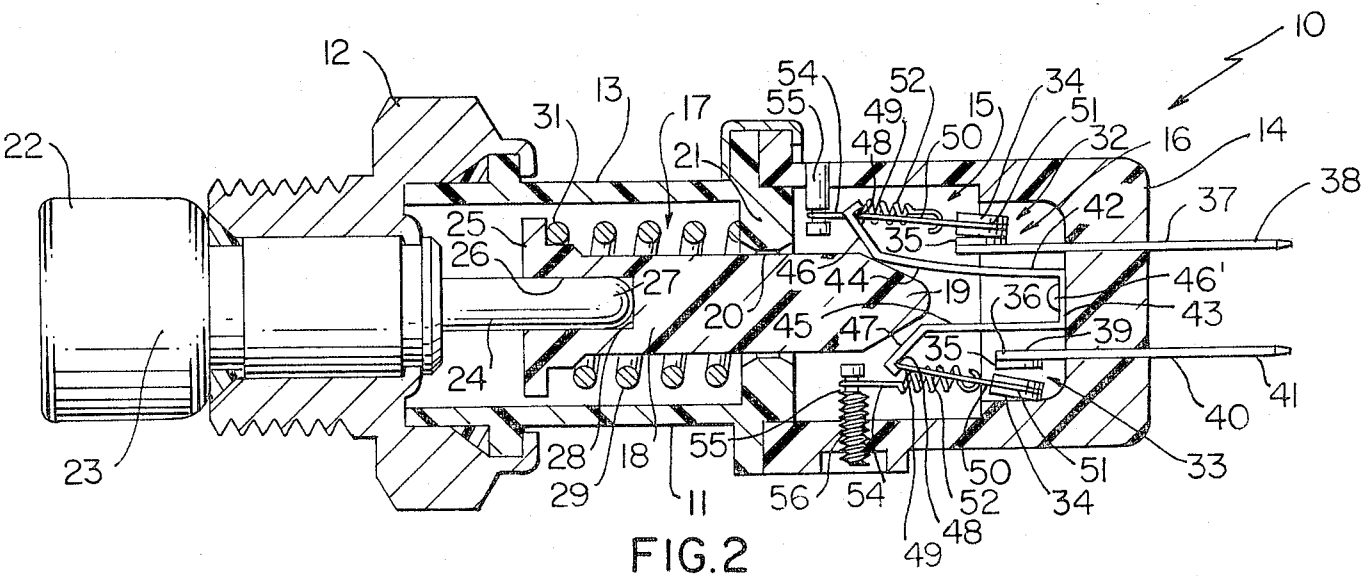
FIG. 2 is a view similar to FIG. 1 and illustrates the electrical switch construction in one of the operating conditions thereof.
Figure 3:
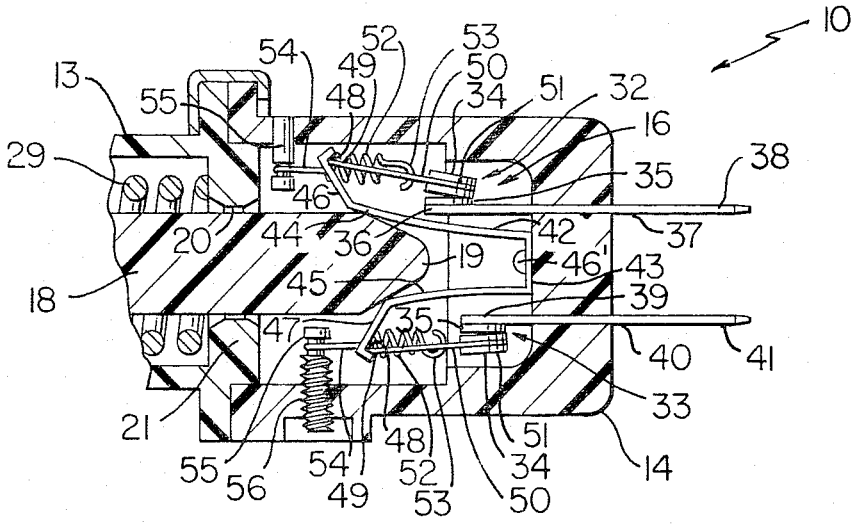
FIG. 3 is a fragmentary view similar to FIG. 1 and illustrates the electrical switch construction in another operating condition thereof.
Figure 4:
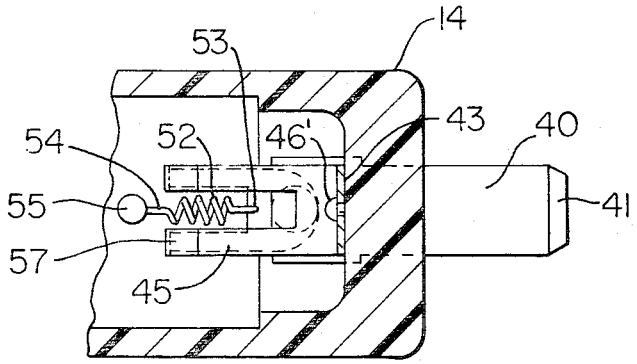
FIG. 4 is a fragmentary cross-sectional view taken on line 4—4 of FIG. 1.

The stem means or plunger 18 is formed from electrically insulating material and has the end 25 thereof interrupted by a closed end bore 26 which receives the piston 24 of the thermal device 22 therein so that the end 27 of the piston 24 can abut against an internal shoulder 28 of the stem 18 to cause the stem 18 to move therewith as the piston 24 is axially extended out of the cylinder 23 in the manner illustrated in FIGS. 2 and 3 as the thermal device 22 senses increased predetermined temperatures in a manner well known in the art.

A compression spring 29 that telescopes about the stem 18 has one end 30 bearing against the wall 21 and the other end 31 thereof bearing against the end 25 of the stem 18 to tend to maintain the stem 18 against the free end 27 of the piston 24 so that the stem 18 will follow axial movement of the piston 24 in both its extended condition and its retracted condition as is well known in the art.

The housing members 13 and 14 of the housing means 11 of the temperature responsive electrical switch construction 10 of this invention can also be formed of electrically insulating material.

The electrical switch means 16 of this invention comprises two pairs 32 and 33 of electrical contact means 34 and 35, each contact means 35 being a fixed contact means and each contact means 34 being a movable contact means.

The fixed contact means 35 of the pair or electrical switch 32 is carried on an end 36 of an electrical terminal 37 that projects into the housing means 11 and has its other end 38 disposed outboard of the housing means 11 for electrical interconnection purposes.

Similarly, the fixed contact 35 of the other pair or electrical switch 33 is secured to the end 39 of another conductive terminal 40 that projects into the housing means 11 while its other end 41 is disposed outboard of the housing means 11 for electrical interconnection purposes.

A conductive flexible member 42 is disposed in the chamber 15 and is substantially U-shaped to define a cross member 43 and a pair of legs 44 and 45 extending therefrom, the cross member 43 being secured to the housing means 14 by suitable fastening means 46'. The legs 44 and 45 of the flexible member 42 are of different length and respectively have bent free ends 46 and 47 respectively provided with pivot means 48 against which pivot ends 49 of conductive pivot members 50 engage, each pivot member 50 having its other end 51 carrying the movable contact 34 of its respective switch 32 or 33 as illustrated.

Figure 5:
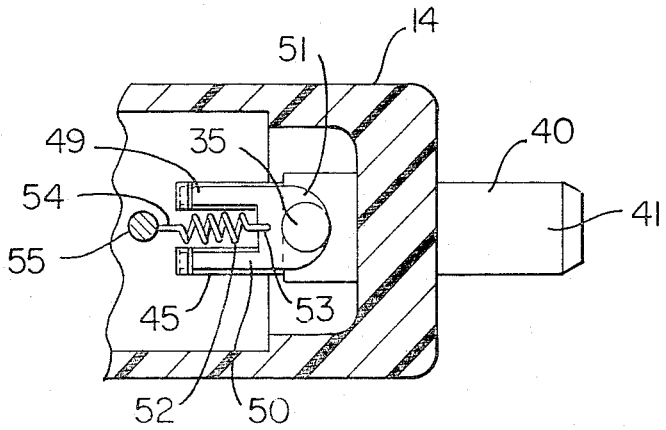
FIG. 5 is a fragmentary cross-sectional view taken on line 5—5 of FIG. 1.

As best illustrated in FIG. 5, each pivot member 50 has its end 49 bifurcated so that a tension spring 52 can have one end 53 thereof interconnected to the end 51 of the pivot member 50 while the other end 54 of the tension spring 52 can be interconnected to a post 55 carried by the housing means 11, the post 55 for the tension spring 52 for the electrical switch 33 being threadedly adjustable through a threaded portion 56 thereof for a purpose hereinafter described.

In this manner, the normal bias of the legs 44 and 45 of the flexible member 42 is to so position the pivot means 48 thereof that the tension springs 52 hold the movable contacts 34 out of contact with the fixed contacts 35 in the manner illustrated in FIG. 1.

However, when the free cone-shaped end 19 of the stem means 18 cams against the free end 46 of the leg 44 of the flexible member 42 in the manner illustrated in FIG. 2 to cam the leg 44 outwardly and, thus, cams the pivot means 48 thereof beyond the center line of the tension spring 52 for the electrical switch 32, the tension spring 52 snaps the pivot member 50 for the electrical switch 32 in a direction to cause the movable contact 34 thereof to be placed into electrical contact with the fixed contact 35 as illustrated in FIG. 2 to complete an electrical circuit between the terminal 37 and the flexible member 42.

Thus, by having the flexible member 42 interconnected to another terminal (not shown), the electrical switch 32 will complete an electrical circuit between the terminal 37 and the flexible member 42 as long as the temperature sensing device 22 has moved the stem means 18 to at least the position illustrated in FIG. 2.

Of course, it is to be understood that the stem means 18 could be made of conductive material and be suitably electrically interconnected to ground by a ground strap or the like disposed between the conductive housing member 12 and the end 30 of the spring 29 so that the flexible member 42 will be grounded when the stem means 18 engages against the free end 46 of the leg 44 in the manner illustrated in FIG. 2. In this manner the terminal 37 will be interconnected to ground when the electrical switch 32 is closed.

In any event, when the temperature responsive device 22 senses a temperature below the predetermined temperature that extended the piston 24 to the position illustrated in FIG. 2, the contraction of the wax charge in the device 22 permits the piston member 24 to be retracted therein under the force of the compression spring 29 so as to move the stem means 18 out of engagement with the flexible member 42 and thereby permit the electrical switch 32 to open to the condition illustrated in FIG. 1 when the pivot means 48 of the leg 44 again moves across the centerline of the tension spring 52 so that the tension spring 52 can snap the pivot member 50 for the movable contact 34 of the electrical switch 32 to the open condition thereof as illustrated in FIG. 1.

When the temperature responsive electrical switch construction 10 of this invention is in the condition illustrated in FIG. 2 so that the switch means 32 is in the closed condition thereof, it can be seen that the leg 45 of the flexible member 42 is sufficiently shorter than the leg 44 of the flexible member 42 so that the stem means 18 does not have its cam end 19 in engagement with the free end 47 of the leg 45 whereby the electrical switch means 33 remains in its open condition. However, as the temperature being sensed by the device 22 increases to a second predetermined temperature thereof, the piston member 24 is extended from the position illustrated in FIG. 2 to the position illustrated in FIG. 3 so that the stem means 18 has its cam end 19 camming against the free end 47 of the leg 45 to cause the pivot means 48 thereof to move over the centerline of the tension spring 52. In this manner, the tension spring 52 will snap the pivot member 50 for the electrical switch 33 to a position where the movable contact 34 is placed into electrical contact with the fixed contact 35 as illustrated in FIG. 3 whereby an electrical connection is provided between the terminal 40 and the flexible member 42.

In this manner, it can be seen that the electrical switch construction 10 of this invention is adapted to close the electrical switch 32 at one predetermined sensed temperature of the device 22 and to close the electrical switch 33 at another predetermined sensed temperature of the device 22, the electrical switch 33 closing at a higher predetermined temperature than the temperature that causes the electrical switch 32 to close. Of course, upon falling sensed temperature, the electrical switch 33 will open before the electrical switch 32 opens.

In order to calibrate the electrical switches 32 and 33 to cause the same to respectively close and open at the desired different predetermined sensed temperatures of the device 22, the electrical switch 32 is calibrated by merely dimpling the cylinder 23 of the device 22 in a conventional manner so that the stem means 18 will close the electrical switch 32 when the sensed temperature of the device 22 causes the stem 18 to move to the required position for closing the electrical switch 32 in a manner well known in the art.

However, the electrical switch 33 is calibrated by threadedly adjusting the post 55 therefor through the threaded connection 56 so that the electrical switch 33 will close when the stem end 19 has cammed the free end 47 of the leg 45 to cause the tension spring 52 to snap the movable contact 34 against the fixed contact 35 at the desired second predetermined temperature sensed by the device 22.

Therefore, it can be seen that the temperature responsive electrical switch construction 10 of this invention can be formed by the method of this invention in a relatively simple manner to operate in a manner now to be described.

If the thermal device 22 is sensing a temperature below the first predetermined actuating temperature thereof, the stem means 18 has its cam end 19 held out of contact with the legs 44 and 45 of the flexible member 42 so that the natural bias of the legs 44 and 45 holds the pivot means 48 thereof in a condition thereof so that the tension springs 52 maintain the pivot members 50 in their out condition whereby the movable contacts 34 are held against the non-conductive housing part 14 and, thus, out of contact with the fixed contacts 35 so the electrical switches 32 and 33 are in an open condition thereof.

However, when the thermal device 22 senses the first predetermined operating temperature thereof, the wax charge in the cylinder 23 thereof has expanded in such a manner that the piston 24 has been extended to the position illustrated in FIG. 2 where the stem means 18 has its end 19 sufficiently camming the free end 46 of the leg 44 to cause the pivot means 48 thereof to move across the centerline of the tension spring 52 and thereby cause the tension spring 52 to snap the pivot member 50 for the electrical switch 32 in a direction to move the movable contact 34 thereof into electrical contact with the fixed contact 35 as illustrated in FIG. 2 whereby the electrical switch 32 will remain in the closed condition as long as the temperature sensing device 22 is sensing a temperature at the first predetermined temperature thereof or above, as the case may be.

When the temperature being sensed by the device 22 has increased to the second predetermined temperature thereof, the piston 24 has been extended further to the right in the drawings to cause the stem means 18 to have the cam end 19 thereof cam against the free end 47 of the leg 45 in the manner illustrated in FIG. 3 and thereby move the pivot means 48 of the leg 45 across the centerline of the tension spring 52 so that the tension spring 52 will snap the pivot member 50 for the electrical switch 33 in a direction to move the movable contact 34 against the fixed contact 35 and thereby close the electrical switch 33 as illustrated in FIG. 3.

Thus, the electrical switch 33 will remain in the closed condition of FIG. 3 as long as the device 22 is sensing the second predetermined temperature or a temperature above the same, as the case may be.

It has been found according to the teachings of this invention that as the stem means 18 moves back to the left upon a falling sensed temperature, the same causes an excellent rocking or wiping action of the closed contacts 34 and 35 before the same are opened so as to break any welded condition therebetween.

Figure 6:
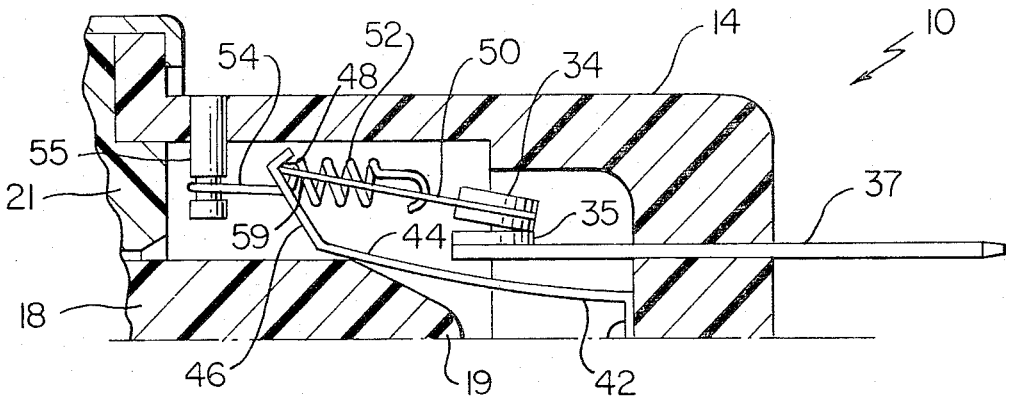
FIG. 6 is a fragmentary enlarged view similar to FIG. 3 and illustrates one position of one pair of the contact means thereof.
Figure 7:
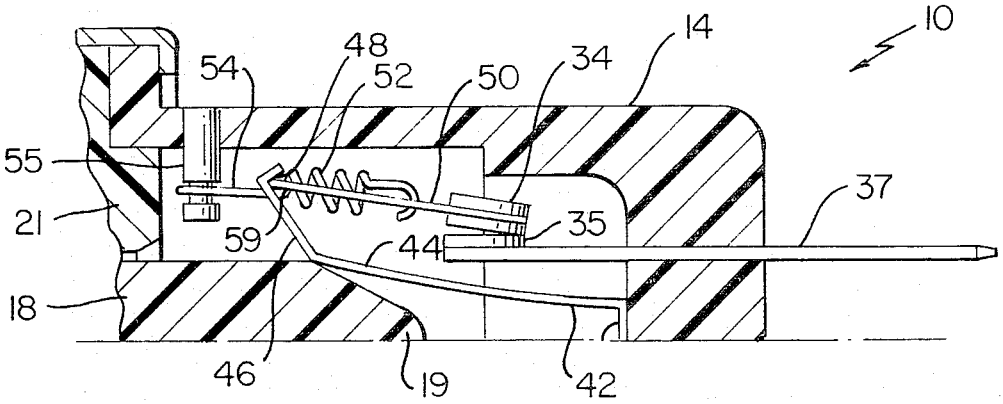
FIG. 7 is a view similar to FIG. 6 and illustrates another condition of the one pair of the contact means thereof.
Figure 8:
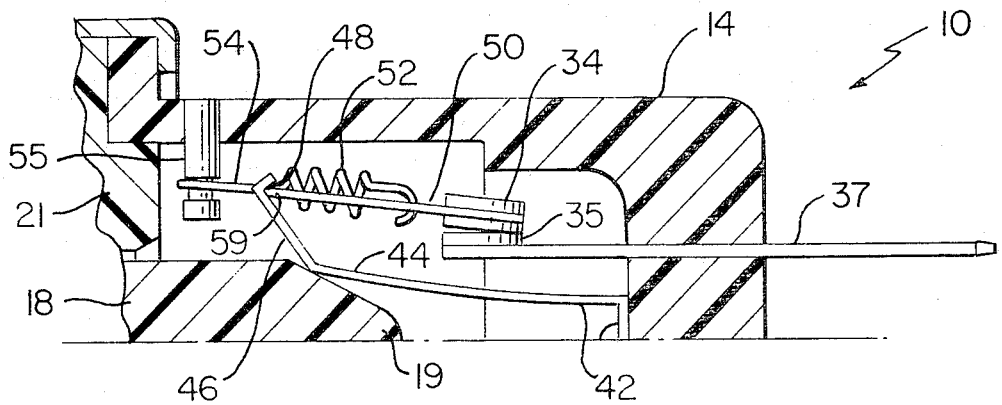
FIG. 8 is a view similar to FIG. 7 and illustrates a further condition of the one pair of the contact means thereof.

For example, reference is now made to FIGS. 6–8 wherein it can be seen that as the cam end 19 of the stem means 18 progressively moves from right to left upon a falling sensed temperature at the critical predetermined operating temperature of the switch construction 10, the cam end 19 causes the particular leg 44 or 45 of the flexible member 42 to move its respective pivot means 48 in such a manner that before the respective tension spring 52 snaps the pivot member 50 to the open position thereof, the movable contact 34 continuously rocks from its main closed condition of FIG. 6 progressively toward the condition illustrated in FIG. 8 to break any weld between the movable contact 34 and the fixed contact 35. Thereafter the pviot means 48 is moved across the centerline of the tension spring 52 to cause the respective tension spring 52 to snap the pivot member 50 to its complete open position as illustrated in FIG. 2 or FIG. 1, as the case may be.

Therefore, it can be seen that as the temperature sensed by the thermal device 22 falls from the predetermined temperature that operated the second electrical switch means 33 in the manner illustrated in FIG. 3, the electrical switch 33 opens after the cam end 19 of the stem means 18 has moved away from the free end 47 of the leg 45 a distance sufficient to permit the natural bias of the leg 45 to move its pivot means 48 across the centerline of the tension spring 52 so that tension spring 52 will snap the pivot member 50 to the open condition illustrated in FIG. 2 whereby the electrical switch 33 is now in its open condition.

A subsequent falling of the sensed temperature of the device 22 below the first operating predetermined temperature thereof will cause the piston 24 to further retract into the cylinder 23 of the device 22 under the force of the compression spring 29 so that should the sensed temperature fall below the first predetermined actuating temperature thereof, the cam end 19 of the stem means 18 will move to the left sufficiently to permit the natural bias of the leg 44 to move its pivot means 48 across the centerline of its respective tension spring 52 so that the tension spring 52 will open the second electrical switch 32 in the manner illustrated in FIG. 1 by snapping the pivot member 50 in a direction away from the fixed contact 35.

Therefore, it can be seen that the temperature responsive electrical switch construction 10 of this invention will operate the electrical switches 32 and 33 at different operating temperatures for any desired purpose while at the same time providing excellent wiping or rocking action of the movable and fixed contacts 34, 35 thereof to break any welds therebetween during the serial opening of the electrical switches 33 and 32 in the manner previously described.

Thus, this invention not only provides an improved temperature responsive electrical switch construction and method of making the same, but also this invention provides improved parts for such an electrical switch construction and method of making the same.

While the forms and methods of this invention now preferred have been illustrated and described as required by the Patent Statute, it is to be understood that other forms and method steps can be utilized and still fall within the scope of the appended claims.

What is claimed is:

1. In a temperature responsive electrical switch construction having electrical contact means operated by a stem means of a piston and cylinder type thermal device carried by said construction, the improvement wherein said contact means comprises a plurality of pairs of cooperating contacts arranged to have each cooperating pair thereof operated serially by said stem means as said thermal device senses different predetermined temperatures, each said pair of cooperating contacts comprising a fixed contact and a movable contact, said construction having a plurality of terminals projecting therefrom and being substantially parallel to each other and to said stem means, said fixed contacts being respectively carried by said terminals.

2. A temperature responsive electrical switch construction as set forth in claim 1 wherein each movable contact is snap-acting.

3. A temperature responsive electrical switch construction as set forth in claim 2 wherein each movable contact has a pivot member pivotally mounted to said construction.

4. A temperature responsive electrical switch construction as set forth in claim 3 wherein each movable contact has a tension spring provided with opposed ends, one of said ends of each tension spring being interconnected to its respective pivot member and the other of said ends thereof being interconnected to said construction.

5. A temperature responsive electrical switch construction as set forth in claim 4 wherein one of said springs has an adjustable member interconnecting said other end thereof to said construction.

6. A temperature responsive electrical switch construction as set forth in claim 4 and including a flexible means carried by said construction and having pivot means thereon that pivotally mount said pivot members to said construction.

7. A temperature responsive electrical switch construction as set forth in claim 6 wherein said stem means of said device engages and flexes said flexible means to serially move said pivot means and thereby cause said springs to serially be overcenter and operate said pivot members to serially operate said pairs of contacts.

8. In a temperature responsive electrical switch construction having electrical contact means operated by a stem means of a piston and cylinder type thermal device carried by said construction, the improvement wherein said contact means comprises a plurality of pairs of cooperating contacts arranged to have each cooperating pair thereof operated serially by said stem means as said thermal device senses different predetermined temperatures, each said pair of cooperating contacts comprising a fixed contact and a movable contact, each movable contact being snap-acting, each movable contact having a pivot member pivotally mounted to said construction, each movable contact having a tension spring provided with opposed ends, one of said ends of each tension spring being interconnected to its respective pivot member and the other of said ends thereof being interconnected to said construction, and a flexible means carried by said construction and having pivot means thereon that pivotally mount said pivot members to said construction, said stem means of said device engaging and flexing said flexible means to serially move said pivot means and thereby cause said springs to serially be overcenter and operate said pivot members to serially operate said pairs of contacts, said flexible means comprising a one-piece flexible member.

9. A temperature responsive electrical switch construction as set forth in claim 8 wherein said flexible member is substantially U-shaped with a cross member and pair of legs extending from said cross member, said cross member being secured to said construction and said legs respectively having said pivot means thereon.

10. A temperature responsive electrical switch construction as set forth in claim 9 wherein said legs respectively have free ends, said pivot means for each leg being substantially at said free end thereof.

11. A temperature responsive electrical switch construction as set forth in claim 10 wherein said legs are of different length.

12. A temperature responsive electrical switch construction as set forth in claim 11 wherein said stem means is movable between said legs.

13. A temperature responsive electrical switch construction as set forth in claim 12 wherein said stem means has a cam means that serially engages said legs as said stem means moves adjacent said legs under the control of said device.

14. A temperature responsive electrical switch construction as set forth in claim 13 wherein said stem means has a free end, said cam means of said stem means comprising said free end thereof.

15. In a method of making a temperature responsive electrical switch construction having electrical contact means operated by a stem means of a piston and cylinder type thermal device carried by said construction, the improvement comprising the steps of forming said contact means to comprise a plurality of pairs of cooperating contacts, arranging said contacts so as to have each cooperating pair thereof operated serially by said stem means as said thermal device senses different predetermined temperatures, forming each said pair of cooperating contacts to comprise a fixed contact and a movable contact, forming said construction to have a plurality of terminals projecting therefrom and being substantially parallel to each other and to said stem means, and securing said fixed contacts respectively to said terminals so as to be carried thereby.

16. A method of making a temperature responsive electrical switch construction as set forth in claim 15 and including the step of forming each movable contact to be snap-acting.

17. A method of making a temperature responsive electrical switch construction as set forth in claim 16 and including the step of forming each movable contact to have a pivot member pivotally mounted to said construction.

18. A method of making a temperature responsive electrical switch construction as set forth in claim 17 and including the steps of forming each movable contact to have a tension spring provided with opposed ends, interconnecting one of said ends of each tension spring to its respective pivot member, and interconnecting the other of said ends of each tension spring to said construction.

19. A method of making a temperature responsive electrical switch construction as set forth in claim 18 and including the step of forming one of said springs with an adjustable member that interconnects said other end thereof to said construction.

20. A method of making a temperature responsive electrical switch construction as set forth in claim 18 and including the steps of providing a flexible means to be carried by said construction, and forming said flexible means to have pivot means thereon that pivotally mount said pivot members to said construction.

21. A method of making a temperature responsive electrical switch construction as set forth in claim 20 and including the step of forming said stem means of said device to engage and flex said flexible means to serially move said pivot means and thereby cause said springs to serially be overcenter and operate said pivot members to serially operate said pairs of contacts.

22. In a method of making a temperature responsive electrical switch construction having electrical contact means operated by a stem means of a piston and cylinder type thermal device carried by said construction, the improvement comprising the steps of forming said contact means to comprise a plurality of pairs of cooperating contacts, arranging said contacts so as to have each cooperating pair thereof operated serially by said stem means as said thermal device senses different predetermined temperatures, forming each said pair of cooperating contacts to comprise a fixed contact and a movable contact, forming each movable contact to be snap-acting, forming each movable contact to have a pivot member pivotally mounted to said construction, forming each movable contact to have a tension spring provided with opposed ends, interconnecting one of said ends of each tension spring to its respective pivot members, interconnecting the other of said ends of each tension spring to said construction, providing a flexible means to be carried by said construction, forming said flexible means to have pivot means thereon that pivotally mount said pivot members to said construction, forming said stem means of said device to engage and flex said flexible means to serially move said pivot means and thereby cause said springs to serially be overcenter and operate said pivot members to serially operate said pairs of contacts, and forming said flexible means to comprise a one-piece flexible member.

23. A method of making a temperature responsive electrical switch construction as set forth in claim 22 and including the steps of forming said flexible member to be substantially U-shaped with a cross member and pair of legs extending from said cross member, securing said cross member to said construction, and forming said legs to respectively have said pivot means thereon.

24. A method of making a temperature responsive electrical switch construction as set forth in claim 23 and including the steps of forming said legs to respectively have free ends, and forming said pivot means for each leg substantially at said free end thereof.

25. A method of making a temperature responsive electrical switch construction as set forth in claim 24 and including the step of forming said legs to be of different length.

26. A method of making a temperature responsive electrical switch construction as set forth in claim 25 and including the step of disposing said stem means to be movable between said legs.

27. A method of making a temperature responsive electrical switch construction as set forth in claim 26 and including the step of forming said stem means to have a cam means that serially engages said legs as said stem means moves adjacent said legs under the control of said device.

28. A method of making a temperature responsive electrical switch construction as set forth in claim 27 and including the steps of forming said stem means to have a free end, and forming said cam means of said stem means to comprise said free end thereof.

29. In an electrical switch construction having electrical contact means operated by an axially movable plunger means carried by said construction, said contact means comprising a plurality of pairs of cooperating contacts arranged to have each cooperating pair thereof operated serially by said plunger means as said plunger means axially moves between said pairs of cooperating pairs of contact means, each said pair of cooperating contacts comprising a fixed contact and a movable contact, the improvement wherein said construction has a plurality of terminals projecting therefrom and being substantially parallel to each other and to said plunger means, said fixed contacts being respectively carried by said terminals.

30. An electrical switch construction as set forth in claim 29 wherein each movable contact is snap-acting.

31. An electrical switch construction as set forth in claim 30 wherein each movable contact has a pivot member pivotally mounted to said construction.

32. An electrical switch construction as set forth in claim 31 wherein each movable contact has a tension spring provided with opposed ends, one of said ends of each tension spring being interconnected to its respective pivot member and the other of said ends thereof being interconnected to said construction.

33. An electrical switch construction as set forth in claim 32 wherein one of said springs has an adjustable member interconnecting said other end thereof to said construction.

34. An electrical switch construction as set forth in claim 32 and including a flexible means carried by said construction and having pivot means thereon that pivotally mount said pivot members to said construction.

35. An electrical switch construction as set forth in claim 34 wherein said plunger means engages and flexes said flexible means to serially move said pivot means and thereby cause said springs to serially be overcenter and operate said pivot members to serially operate said pairs of contacts.

36. In an electrical switch construction having electrical contact means operated by an axially movable plunger means carried by said construction, said contact means comprising a plurality of pairs of cooperating contacts arranged to have each cooperating pair thereof operated serially by said plunger means as said plunger means axially moves between said pairs of cooperating pairs of contact means, each said pair of cooperating contacts comprising a fixed contact and a movable contact, each movable contact being snap-acting, each movable contact having a pivot member pivotally mounted to said construction, the improvement wherein each movable contact has a tension spring provided with opposed ends, one of said ends of each tension spring being interconnected to its respective pivot member and the other of said ends thereof being interconnected to said construction, and a flexible means carried by said construction and having pivot means thereon that pivotally mount said pivot members to said construction, said plunger means engaging and flexing said flexible means to serially move said pivot means and thereby cause said springs to serially be overcenter and operate said pivot members to serially operate said pairs of contacts, said flexible means comprising a one-piece flexible member.

37. An electrical switch construction as set forth in claim 36 wherein said flexible member is substantially U-shaped with a cross member and pair of legs extending from said cross member, said cross member being secured to said construction and said legs respectively having said pivot means thereon.

38. An electrical switch construction as set forth in claim 37 wherein said legs respectively have free ends, said pivot means for each leg being substantially at said free end thereof.

39. An electrical switch construction as set forth in claim 38 wherein said legs are of different length.

40. An electrical switch construction as set forth in claim 39 wherein said plunger means is movable between said legs.

41. An electrical switch construction as set forth in claim 40 wherein said plunger means has a cam means that serially engages said legs as said plunger means moves adjacent said legs.

42. An electrical switch construction as set forth in claim 41 wherein said plunger means has a free end, said cam means of said plunger means comprising said free end thereof.

43. In a method of making an electrical switch construction having electrical contact means operated by an axially movable plunger means carried by said construction, said method comprising the steps of forming said contact means to comprise a plurality of pairs of cooperating contacts, arranging said contacts so as to have each cooperating pair thereof operated serially by said plunger means as said plunger means axially moves between said pairs of cooperating contact means, and forming each said pair of cooperating contacts to comprise a fixed contact and a movable contact, the improvement comprising the steps of forming said construction to have a plurality of terminals projecting therefrom and being parallel to each other and to said plunger means, and securing said fixed contacts respectively to said terminals so as to be carried thereby.

44. A method of making an electrical switch construction as set forth in claim 43 and including the step of forming each movable contact to be snap-acting.

45. A method of making an electrical switch construction as set forth in claim 44 and including the step of forming each movable contact to have a pivot member pivotally mounted to said construction.

46. A method of making an electrical switch construction as set forth in claim 45 and including the steps of forming each movable contact to have a tension spring provided with opposed ends, interconnecting one of said ends of each tension spring to its respective pivot member, and interconnecting the other of said ends of each tension spring to said construction.

47. A method of making an electrical switch construction as set forth in claim 46 and including the step of forming one of said springs with an adjustable member that interconnects said other end thereof to said construction.

48. A method of making an electrical switch construction as set forth in claim 46 and including the steps of providing a flexible means to be carried by said construction, and forming said flexible means to have pivot means thereon that pivotally mount said pivot members to said construction.

49. A method of making an electrical switch construction as set forth in claim 48 and including the step of forming said plunger means to engage and flex said flexible means to serially move said pivot means and thereby cause said springs to serially be overcenter and operate said pivot members to serially operate said pairs of contacts.

50. In a method of making an electrical switch construction having electrical contact means operated by an axially movable plunger means carried by said construction, said method comprising the steps of forming said contact means to comprise a plurality of pairs of cooperating contacts, arranging said contacts so as to have each cooperating pair thereof operated serially by said plunger means as said plunger means axially moves between said pairs of cooperating contact means, forming each said pair of cooperating contacts to comprise a fixed contact and a movable contact, forming each movable contact to be snap-acting, and forming each movable contact to have a pivot member pivotally mounted to said construction, the improvement comprising the steps of forming each movable contact to have a tension spring provided with opposed ends, interconnecting one of said ends of each tension spring to its respective pivot member, interconnecting the other of said ends of each tension spring to said construction, providing a flexible means to be carried by said construction, forming said flexible means to have pivot means thereon that pivotally mount said pivot members to said construction, forming said plunger means to engage and flex said flexible means to serially move said pivot means and thereby cause said springs to serially be overcenter and operate said pivot members to serially operate said pairs of contacts, and forming said flexible means to comprise a one-piece flexible member.

51. A method of making an electrical switch construction as set forth in claim 50 and including the steps of forming said flexible member to be substantially U-shaped with a cross member and pair of legs extending from said cross member, securing said cross member to said construction, and forming said legs to respectively have said pivot means thereon.

52. A method of making an electrical switch construction as set forth in claim 51 and including the steps of forming said legs to respectively have free ends, and forming said pivot means for each leg substantially at said free end thereof.

53. A method of making an electrical switch construction as set forth in claim 52 and including the step of forming said legs to be of different length.

54. A method of making an electrical switch construction as set forth in claim 53 and including the step of disposing said plunger means to be movable between said legs.

55. A method of making an electrical switch construction as set forth in claim 54 and including the step of forming said plunger means to have a cam means that serially engages said legs as said plunger means moves adjacent said legs.

56. A method of making an electrical switch construction as set forth in claim 55 and including the steps of forming said plunger means to have a free end, and forming said cam means of said plunger means to comprise said free end thereof.

* * * * *